US009201320B2

(12) United States Patent
Nakahara et al.

(10) Patent No.: US 9,201,320 B2
(45) Date of Patent: Dec. 1, 2015

(54) PRODUCTION PROCESS OF ORGANIC PHOTORECEPTOR

(71) Applicant: Konica Minolta, Inc., Tokyo (JP)

(72) Inventors: Hiroshi Nakahara, Tokyo (JP); Shinichi Hamaguchi, Tokyo (JP); Tomoo Sakimura, Tokyo (JP); Mayuko Matsusaki, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 39 days.

(21) Appl. No.: 14/294,735

(22) Filed: Jun. 3, 2014

(65) Prior Publication Data

US 2014/0377702 A1 Dec. 25, 2014

(30) Foreign Application Priority Data

Jun. 19, 2013 (JP) ..... 2013-128461

(51) Int. Cl.
*G03G 5/00* (2006.01)
*G03G 5/14* (2006.01)

(52) U.S. Cl.
CPC ..... *G03G 5/144* (2013.01)

(58) Field of Classification Search
CPC ..... G03G 5/144
USPC ..... 430/131, 65
See application file for complete search history.

(56) References Cited

FOREIGN PATENT DOCUMENTS

| | | |
|---|---|---|
| JP | 2005-134924 A | 5/2005 |
| JP | 2008-134425 | 6/2008 |
| JP | 2011-065028 | 3/2011 |
| JP | 2013-097221 | 5/2013 |

OTHER PUBLICATIONS

Office Action dated May 26, 2015 issued from the corresponding Japanese Patent Application No. 20123-128461.
English translation of Office Action dated May 26, 2015 issued from the corresponding Japanese Patent Application No. 20123-128461.
Masato Yamamura "Coating, Drying and Microstructuring of Suspensions" Hosokawa Micron Corporation, Dec. 29, 2011, No. 55, 19-25.

*Primary Examiner* — Mark A Chapman
(74) *Attorney, Agent, or Firm* — Lucas & Mercanti, LLP

(57) ABSTRACT

Disclosed is a production process of an organic photoreceptor which can suppress occurrence of uneven density and image defects. The production process of an organic photoreceptor, the organic photoreceptor including an intermediate layer and an organic photosensitive layer on the intermediate layer, includes: applying a coating liquid for forming the intermediate layer to a conductive support to form a coating film, the coating liquid being obtained by dissolving a binder resin in a solvent and dispersing first and second metal oxide fine particles therein; and drying the coating film. The Pe number of the first metal oxide fine particles is two or more times larger than that of the second metal oxide fine particles.

$Pe \text{ number} = (6\pi\mu EHR)/kT$ Equation (1):

10 Claims, 1 Drawing Sheet

DIRECTION OF ROTATIONAL AXIS OF ORGANIC PHOTORECEPTOR

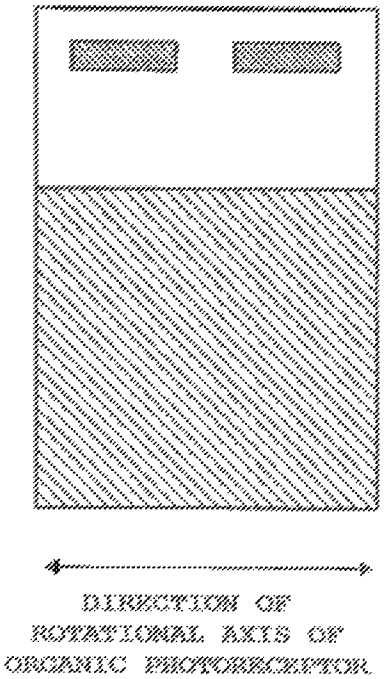
DIRECTION OF
ROTATIONAL AXIS OF
ORGANIC PHOTORECEPTOR

PRODUCTION PROCESS OF ORGANIC PHOTORECEPTOR

CROSS REFERENCE TO RELATED APPLICATION

This Application claims the priority of Japanese Patent Application No. 2013-128461 filed on Jun. 19, 2014, which is incorporated by reference herein.

TECHNICAL FIELD

The present invention relates a production process of an organic photoreceptor for use in an image forming apparatus of an electrophotographic system.

BACKGROUND ART

Currently, negatively-chargeable photoreceptors having a layered structure have been widely used as a photoreceptor installed in image forming apparatuses of an electrophotographic system such as copying machines and printers. In general negatively-chargeable photoreceptors having a layered structure, an intermediate layer and a photosensitive layer including a charge generating layer and a charge transport layer formed thereon are stacked on a conductive support. In such negatively-chargeable photoreceptors having a layered structure, the surface thereof is negatively charged and exposed to light to generate charges in the charge generating layer. Negative charges (electrons) of these charges move to the conductive support through the intermediate layer, while positive holes (holes) move to the surface of the photoreceptor through the charge transport layer to cancel negative charges on the surface, whereby forming an electrostatic latent image. Accordingly, the intermediate layer has been required to have an electron transport property (to readily transfer electrons generated in the charge generating layer by the exposure to the conductive support) and a positive hole-blocking property (to prevent injection of positive holes to the photosensitive layer from the conductive support).

Recently, image forming apparatuses of an electrophotographic system such as copying machines and printers have been required to have further improved image quality. Specific requests for improvement in image quality include improvement in uneven density in a page or between pages. In order to improve uneven density, various measures have been taken in image forming apparatuses.

Uneven density may be caused by insufficient electron transport property of the intermediate layer. Accordingly, uneven density characteristic may be solved by improving the electron transport property of the intermediate layer. For example, Patent Literature 1 discloses that the electron transport property of an intermediate layer is improved by containing metal oxide fine particles in the intermediate layer.

However, when the electron transport property of the intermediate layer is simply improved, i.e., when a particularly-sensitive charge generating material is used, injection of irregular electrons from the charge generating layer cannot be prevented, causing a problem of image defects such as spots and fogging.

CITATION LIST

Patent Literature

Patent Literature 1: Japanese Patent Application Laid-Open No. 2005-134924

SUMMARY OF INVENTION

Technical Problem

The present invention has been made in view of the foregoing circumstances and has as its object the provision of a production process of an organic photoreceptor which cart suppress occurrence of uneven density as well as image defects such as spots and fogging.

Solution to Problem

To achieve at least one of the above mentioned objects, a production process of an organic photoreceptor reflecting one aspect of the present invention is a production process of an organic photoreceptor, the organic photoreceptor including a conductive support, an intermediate layer formed on the conductive support, and an organic photosensitive layer stacked on the intermediate layer, the process including:

applying a coating liquid for forming the intermediate layer to the conductive support to form a coating film, the coating liquid being obtained by dissolving a binder resin in a solvent and dispersing first and second metal oxide fine particles therein; and drying the coating film, wherein a Pe number of the first metal oxide fine particles is two or more times larger than that of the second metal oxide fine particles when the Pe number defined by a following Equation (1) is measured for following Pe number evaluation liquids under following measurement conditions using the first and second metal oxide fine particles.

$$Pe\ \text{number}=(6\pi\mu EHR)/kT \qquad \text{Equation (1):}$$

[in the Equation (1), μ represents the viscosity (Pa·s) of Pe number evaluation liquid 2, E represents the liquid film contraction rate (m/s) when a wet film of Pe number evaluation liquid 1 is formed, H represents the wet film thickness of Pe number evaluation liquid 1, R represents the number average primary particle size (m) of the metal oxide fine particles, k represents Boltzmann constant (J/K), and T represents the liquid temperature (K).]

Measurement Conditions:

Pe number evaluation liquid 1: obtained by dissolving 100 parts by mass of a binder resin in 1700 parts by mass of a solvent and dispersing 260 parts by mass of the first or second metal oxide fine particles in the solvent, wherein the binder resin and the solvent are the same as those used in the coating liquid for forming the intermediate layer;

Pe number evaluation liquid 2: obtained by dissolving 100 parts by mass of a binder resin in 850 parts by mass of a solvent and dispersing 260 parts by mass of the first or second metal oxide fine particles in the solvent, wherein the binder resin and the solvent are the same as those used in the coating liquid for forming the intermediate layer;

Liquid temperature: 296 K; and

Wet film thickness: $32\times10^{-6}$ m.

In the above mentioned production process of an organic photoreceptor, the Pe number of the first metal oxide fine particles is preferably not less than 200.

In the above mentioned production process of an organic photoreceptor, the first and second metal oxide fine particles are each preferably made of either one of titanium oxide and zinc oxide, more preferably titanium oxide, particularly preferably rutile type titanium oxide.

In the above mentioned production process of an organic photoreceptor, a number average primary particle size of the first metal oxide fine particles and a number average primary particle size of the second metal oxide fine particles are each preferably 5 to 100 nm, more preferably 10 to 40 nm.

In the above mentioned production process of the organic photoreceptor, the organic photosensitive layer preferably contains as a charge generating material a Y-form titanyl phthalocyanine pigment or a mixture of a titanyl phthalocyanine pigment and a pigment of an adduct of titanyl phthalocyanine and 2,3-butanediol.

In the above mentioned production process of an organic photoreceptor, a thickness of the intermediate layer is preferably 0.5 to 25 μm, more preferably 1 to 7 μm.

Advantageous Effects of Invention

The production process of the organic photoreceptor includes: applying a coating liquid for forming an intermediate layer to form a coating film, the coating liquid being obtained by dissolving a binder resin in a solvent and dispersing first and second metal oxide fine particles therein; and drying the coating film, and the Pe number of the first metal oxide fine particles is two or more times larger than that of the second metal oxide fine particles, the Pe number being measured under specific measurement conditions. Accordingly, an organic photoreceptor which can suppress occurrence of uneven density and image defects such as spots and fogging can be produced.

BRIEF DESCRIPTION OF DRAWINGS

FIG. 1 is a diagram illustrating a chart used for evaluating image quality in Examples.

DESCRIPTION OF EMBODIMENTS

The present invention will be described below in detail.

Production Process of Organic Photoreceptor:

A production process of the present invention can produce an organic photoreceptor including a conductive support, an intermediate layer formed on the conductive support, and an organic photosensitive layer stacked on the intermediate layer. The process includes: applying a coating liquid for forming the intermediate layer to the conductive support to form a coating film, the coating liquid being obtained by dissolving a binder resin in a solvent and dispersing first and second metal oxide fine particles therein; and drying the coating film. In the production process, the Pe number of the first metal oxide fine particles is two or more times larger than that of the second metal oxide fine particles when the Pe number defined by Equation (1) below is measured for Pe number evaluation liquids described below under the following measurement conditions using the first and second metal oxide fine particles.

In the present invention, the organic photoreceptor refers to a photoreceptor of which at least one of the charge generating function and the charge transport function, essential for the configuration of the organic photoreceptor, is exerted by an organic compound, and examples of the photoreceptor may include photoreceptors constituted by a known organic charge generating material or organic charge transport material and photoreceptors constituted by a polymer complex to impart the charge generating function and charge transport function.

In the organic photoreceptor obtained by the production process of the present invention, the organic photosensitive layer has functions of generating charges by exposure and transporting generated charges to the surface of the photoreceptor.

The organic photosensitive layer may have a single layer structure having a charge generating function and a charge transport function in the same layer, or may have a layered structure having a charge generating function and a charge transport function in respective different layers.

The organic photoreceptor obtained by the production process of the present invention is not particularly limited as long as the intermediate layer and the organic photosensitive layer are stacked in this order on the conductive support. However, in order to obtain an organic photoreceptor which prevents an increase in residual potential due to repeated use, the organic photoreceptor preferably has a layered structure of a charge generating layer and a charge transport layer.

The organic photoreceptor having a layered structure obtained by the production process of the present invention is a negatively-chargeable organic photoreceptor. This negatively-chargeable organic photoreceptor includes an intermediate layer, a charge generating layer on the intermediate layer, and a charge transport layer on the charge generating layer, whereas a positively-charged organic photoreceptor includes an intermediate layer, a charge transport layer on the intermediate layer, and a charge generating layer on the charge transport layer.

Hereinafter, a production process of the negatively-chargeable organic photoreceptor having a layered structure will be described.

The organic photoreceptor obtained by the production process of the present invention specifically has the following layer structure (1).

Layer Structure (1) formed by layering an intermediate layer, and a charge generating layer and a charge transport layer as an organic photosensitive layer in this order on a conductive support.

In the organic photoreceptor obtained by the production process of the present invention, a protective layer may be further formed on the organic photosensitive layer.

In the production process of the organic photoreceptor of the present invention, the production process of the organic photoreceptor having the above layer structure (1) described above specifically includes:

Step (1) of forming an intermediate layer by applying a coating liquid for forming the intermediate layer to the outer periphery of a conductive support to form a coating film, and drying the coating film;

Step (2) of forming a charge generating layer by applying a coating liquid for forming the charge generating layer to the outer periphery of the intermediate layer formed on the conductive support to form a coating film, and drying the coating film to; and Step (3) of forming a charge transport layer by applying a coating liquid for forming the charge transport layer to the outer periphery of the charge generating layer formed on the intermediate layer to form a coating film, and drying the coating film.

In the present invention, the coating process of each coating liquid is not particularly limited. As examples of the coating process, may be mentioned dip coating, spray coating, spinner coating, bead coating, blade coating, beam coating and circular volume control coating (coating process using a slide hopper-type coater). The circular volume control coating is described in detail, for example, in Japanese Patent Application Laid-Open No. Sho. 58-189061.

In the present invention, the drying process of each coating liquid is not particularly limited. As examples of the drying process, may be mentioned heat drying.

Step (1): Step of Forming Intermediate Layer:

In Step (1), specifically, a dispersion liquid is prepared by dissolving a binder resin in a solvent and dispersing first and second metal oxide fine particles therein. Subsequently, the dispersion liquid is allowed to stand about for a day and night and filtered to prepare a coating liquid for forming an intermediate layer. Then, the coating liquid for forming an intermediate layer is applied to the outer periphery of the conductive support by the above process to form a coating film, and the coating film is dried to form an intermediate layer.

Conductive Support:

A conductive support to which the coating liquid for forming the intermediate layer is applied is not particularly limited as long as it is conductive. As examples of the conductive support, may be mentioned drum-shaped or sheet-shaped metals of aluminum, copper, chromium, nickel, zinc, stainless steel, and the like; laminates of a plastic film and a metallic foil such as aluminum and copper; plastic films on which aluminum, indium oxide, tin oxide, or the like is deposited; and metals, plastic films, and papers, on which a conductive layer is provided by applying a conductive material either singly or in combination with a binder resin.

Metal Oxide Fine Particles:

In the coating liquid for forming the intermediate layer used in Step (1), at least first and second metal oxide fine particles are contained and dispersed.

These two types of metal oxide fine particles include at least first metal oxide fine particles having a larger Pe number and second metal oxide fine particles having a smaller Pe number. The Pe number of the first metal oxide fine particles is two or more times larger, preferably 3 to 100 times larger, more preferably 5 to 50 times larger than that of the second metal oxide fine particles.

The coating liquid for forming the intermediate layer contains at least the first and second metal oxide fine particles and may contain other metal oxide fine particles than the first and second metal oxide fine particles (hereinafter, referred to as "other metal oxide fine particles"). When the coating liquid for forming the intermediate layer contains other metal oxide fine particles, the Pe number of other metal oxide fine particles may be between that of the first metal oxide fine particles and that of the second metal oxide fine particles, or may be larger than that of the first metal oxide fine particles, or may be smaller than that of the second metal oxide fine particles.

In the present invention, the coating liquid for forming the intermediate layer contains the first and second metal oxide fine particles wherein the Pe number of the first metal oxide fine particles is two or more times larger than that of the second meta oxide fine particles, which may control the orientation between the binder resin and the metal oxide fine particles, i.e., the positional relation of the first and second metal oxide fine particles in the binder resin, to form the intermediate layer. This can prevent injection of irregular electrons from the charge generating layer while the intermediate layer retains high electron transport property, and further can suppress uneven density and image defects such as spots and fogging.

Specifically, if the coating liquid for forming the intermediate layer containing the first and second metal oxide fine particles wherein the Pe number of the first metal oxide fine particles is two or more times larger than that of the second metal oxide fine particles is used, it is assumed that the intermediate layer may be formed while the first metal oxide fine particles having a larger Pe number and the second metal oxide fine particles having a smaller Pe number are unevenly distributed because of difference in Pe number. If a thin layer of the first metal oxide fine particles having a larger Pe number in the intermediate layer is formed, it is assumed that injection of irregular electrons from the charge generating layer and injection of positive holes from the conductive support as well as transfer of irregular electrons injected into the intermediate layer can be effectively suppressed, thereby suppressing image defects such as spots and fogging. Furthermore, if a particularly-sensitive charge generating material is used as a charge generating material in the charge generating layer, it is assumed that image defects such as spots and togging which are caused by leak of a carrier generated by other factors than exposure, such as heat excitation can be suppressed. Since the second metal oxide fine particles having a smaller Pe number contribute to the retention of the electron transport property, the uneven density can also be suppressed effectively.

In the present invention, if the first and second metal oxide fine particles are used with both being present in the coating liquid for forming the intermediate layer, an intermediate layer exerting the effects of the present invention is formed. Although the proportion of the first metal oxide fine particles to the second metal oxide fine particles is not particularly limited, the amount of the first metal oxide fine particles contributing to the blocking property against irregular electrons from the charge generating layer and positive holes from the conductive support is preferably smaller than that of the second metal oxide fine particles contributing to the electron transport property of the entire intermediate layer. This is because the first metal oxide fine particles can exert sufficient functions even with a thin layer. The proportion of the first metal oxide fine particles to the second metal oxide fine particles (by volume ratio) is preferably 1:0.8 to 1:2.3, more preferably 1:1.0 to 1:1.7.

In the present invention, the Pe numbers of the first and second metal oxide fine particles are the values obtained by measuring the Pe number defined by Equation (1) below for Pe number evaluation liquids described below under the following measurement conditions using the first and second metal oxide fine particles.

The Pe number (Peclet number) refers to a dimensionless number representing the ratio of liquid flows caused by contraction of a liquid film due to Brownian motion of particles and drying.

$$Pe\ \text{number}=(6\pi\mu EHR)/kT \qquad \text{Equation (1):}$$

[wherein, μ represents the viscosity (Pa·s) of Pe number evaluation liquid 2, E represents the liquid film contraction rate (m/s) when a wet film of Pe number evaluation liquid 1 is formed. H represents the wet film thickness of Pe number evaluation liquid 1, R represents the number average primary particle size (m) of the metal oxide fine particles, k represents Boltzmann constant (J/K), and T represents the liquid temperature (K).]

Measurement Conditions:

Pe number evaluation liquid 1: obtained by dissolving 100 parts by mass of a binder resin in 1700 parts by mass of a solvent and dispersing 260 parts by mass of the first or second metal oxide fine particles in the solvent, wherein the binder resin and the solvent are the same as those used in the coating liquid for forming the intermediate layer;

Pe number evaluation liquid 2: obtained by dissolving 100 parts by mass of a binder resin in 850 parts by mass of a solvent and dispersing 260 parts by mass of the first or second metal oxide fine particles in the solvent, wherein the binder resin and the solvent are the same as those used in the coating liquid for forming the intermediate layer;

Liquid temperature: 296 K; and

Wet film thickness: $32\times10^{-6}$ m.

As described above, in the Pe number defined by the Equation (1) above, the viscosity (μ) is measured using Pe number evaluation liquid 2 and other parameters are measured using Pe number evaluation liquid 1.

Methods for measuring each parameter will be described below in detail.

First, for the liquid film contraction rate (E), 100 parts by mass of a binder resin is added to 1700 parts by mass of a solvent and mixed under stirring at 20° C. To this solution, 260 parts by mass of the first or second metal oxide fine particles are added and dispersed therein with a bead mill for a mill retention time of 5 hours to prepare Pe number evaluation liquid 1. The liquid film contraction rate (E) for Pe number evaluation liquid 1 is calculated by dividing, by the time for drying, the value obtained by subtracting the dry film thickness from the wet film thickness (H) just after coating, when the wet film of Pe number evaluation liquid 1 is formed to have a thickness (H) of 32 μm with a liquid temperature (T) of 296 K (23° C.). Here, an aluminum-deposited sheet "Metalumy TS (#75)" (manufactured by Toray Advanced Film Co., Ltd.) is used as a surface to be coated with the wet film, and a wire bar (R.D. Specialties, U.S.A., ROD No. 14) is used to form the wet film having a thickness of 32 μm under a room temperature of 23° C. The time for drying refers to the time required for the mass reduction rate for 10 seconds to reach not more than 1% when the mass of the coating during drying is measured at 10-second intervals. Specifically, the time for drying refers to the time required for the mass reduction rate (%) to reach not more than 1% wherein the mass reduction rate (%)=[1−{the weight of the coating after drying for (n+10) seconds/the weight of the coating after drying for n seconds}]×100. The dry film thickness refers to the thickness of the coating after the time for drying when the thickness is measured with a thickness gauge "DIAL GAUGE STAND TYPE SIS-3" (manufactured by PEACOCK). The drying condition is under a room temperature of 23° C.

For the viscosity (μ), 100 parts by mass of a binder resin is added to 850 parts by mass of a solvent and mixed under stirring at 20° C. To this solution, 260 parts by mass of the first or second metal oxide fine particles are added and dispersed therein with a bead mill for a mill retention time of 5 hours to prepare Pe number evaluation liquid 2. The viscosity (μ) of Pe number evaluation liquid 2 is measured at a liquid temperature (T) of 296 K (23° C.) using a B-type viscometer "Model: BL" (manufactured by Tokyo Keiki Inc.).

Furthermore, the number average primary particle size (R) is obtained by the following procedure: observing the TEM (transmission electron microscope) image of the metal oxide fine particles at a magnification of 100,000 times; randomly selecting 100 particles as primary particles; measuring the horizontal Feret diameters of these primary particles on the basis of the image analysis; and calculating the average of the diameters as a "number average primary particle size."

In the present invention, each parameter for calculating the Pe number is preferably observed at a high solid content in order to observe the flow behavior of the metal oxide fine particles during drying process. To evaluate the behavior of the metal oxide fine particles in the intermediate layer, the same solvent and binder resin as in the actual coating liquid for forming the intermediate layer are used.

The Pe number of the first metal oxide fine particles is preferably not less than 200 and not more than 50,000, more preferably not less than 300 and not more than 5,000. The Pe number of the second metal oxide fine particles is preferably not less than 20 and not more than 500, more preferably not less than 50 and not more than 300.

As examples of the first and second metal oxide fine particles, may be used metal oxide fine particles of titanium oxide, zinc oxide, alumina (aluminum oxide), tin oxide, antimony oxide, indium oxide, bismuth oxide, zirconium oxide and the like; and fine particles of tin-doped indium oxide, antimony-doped tin oxide, zirconium oxide and the like. As the first and second metal oxide fine particles, those made of titanium oxide or zinc oxide are preferred, and rutile type titanium dioxide is more preferred.

The number average primary particle size of the first and second metal oxide fine particles is preferably 5 to 100 nm, more preferably 10 to 40 nm.

When the number average primary particle size of the first and second metal oxide fine particles falls within the above range, favorable dispersibility in the coating liquid for forming the intermediate layer can be achieved, thereby imparting sufficient electron transport property to the intermediate layer to be formed. This can substantially suppress occurrence of image defects such as black spots and fogging and further can substantially suppress occurrence of uneven density.

The Pe number of the first and the second metal oxide fine particles can be controlled by treating the surface of the metal oxide fine particles with a surface treatment agent(s). Specifically, the Pe number can be controlled by the type of the metal oxide fine particles, the type of the surface treatment agent, the amount of the surface treatment agent used, and the conditions of the surface treatment. Typically, the Pe number can be changed relatively largely by appropriately selecting the type of the surface treatment agent and the amount of the surface treatment agent used. A more desirable Pe number can be obtained by adjusting the conditions of the surface treatment.

As examples of the surface treatment agent, may be mentioned inorganic compounds and organic compounds. These surface treatment agents may be used either singly or in any combination thereof.

As examples of the inorganic compounds, may be mentioned alumina, silica, zirconia and hydrates thereof. Among these, alumina, silica, and a combination of alumina and silica are particularly preferred because the Pe number of the metal oxide fine particles can be easily controlled. These may be used either singly or in any combination thereof. As the metal oxide fine particles having the surface treated with an inorganic compound(s), commercial products such as titanium oxides treated with silica and/or alumina may be used. As examples of the commercial products, may be mentioned T-805 (manufactured by Nippon Aerosil Co., Ltd.), STT-30A, STT-65S-S (manufactured by Titan Kogyo, Ltd.), TAF-500T, TAF-1500T (manufactured by Fuji Titanium Industry Co., Ltd.), MT-100S, MT-100T, MT-500SA (manufactured by Tayca Corporation) and IT-S (manufactured by Ishihara Sangyo Kaisha, Ltd.).

As examples of the organic compounds, may be mentioned reactive organosilicon compounds and organotitanium compounds.

As examples of the reactive organosilicon compounds, may be mentioned alkoxy silanes such as methyl trimetoxysilane, n-butyl trimethoxysilane, n-hexyl trimethoxysilane, dimethyl dimethoxysilane, 3-methacryloxy propyl methyl diethoxysilane, 3-methacryloxy propyl trimethoxysilane, 3-methacryloxy propyl triethoxysilane, 3-acryloxypropyl trimethoxysilane, 3-acryloxypropyl triethoxysilane, 2-methacryloxyethyl trimethoxysilane, 3-methacryloxy butyl methyl dimethoxysilane; hexamethyldisilazane: and polysiloxane compounds such as methyl hydrogen polysiloxane. Among these, 3-methacryloxy propyl trimethoxysilane, 3-acryloxypropyl trimethoxysilane, and methyl hydrogen polysiloxane are preferred because the Pe number of the metal oxide fine particles can be easily controlled.

As examples of the organotitanium compounds, may be mentioned alkoxy titanium (i.e., titanium alkoxide), titanium polymer, titanium acylate, titanium chelate, tetrabuthyl titanate, tetraoctyl titanate, isopropyl trilsostearoyl titanate, isopropyl tridecylbenzenesulfonyl titanate and bis(dioctylpyrophosphate)oxyacetate titanate. Among these, titanium acylate and titanium chelate are preferred because the Pe number of the metal oxide fine particles can be easily controlled.

The surface treatment process with the surface treatment agent of the organic compound is not particularly limited and can be carried out by a known method. For example, wet processing, dry processing, and the like can be adopted.

As examples of the surface treatment process by dry processing with the surface treatment agent of the organic compound, may be mentioned a process of spraying a solution of the surface treatment agent in alcohol or the like onto a dispersion obtained by crowdedly dispersing non-surface treated metal oxide fine particles (hereinafter, also referred to as "untreated metal oxide fine particles") by stirring or the like, or bringing a vaporized surface treatment agent into contact with the dispersion, thereby attaching the surface treatment agent to the surface.

As examples of the surface treatment process by wet processing with the surface treatment agent of the organic compound, may be mentioned a process including: adding untreated metal oxide fine particles to a solution in which the surface treatment agent is dispersed in water or an organic solvent, followed by mixing under stirring, or dispersing untreated metal oxide fine particles in a solution and adding dropwise thereto the surface treatment agent, thereby attaching the surface treatment agent to the surface; then filtering and drying the obtained solution; and annealing (baking) the obtained metal oxide fine particles. In the wet processing, wet crushing may be performed with a bead mill or the like.

The temperature during mixing under stirring in the above wet processing is preferably about 30 to 150° C., more preferably 40 to 60° C. The time for mixing under stirring is preferably 0.5 to 10 hours, more preferably 1 to 5 hours. The annealing temperature can be, for example, 100 to 220° C., preferably 110 to 150° C. The time for annealing is preferably 0.5 to 10 hours, more preferably 1 to 5 hours. The temperature at wet crushing, when the wet crushing is performed, is preferably 20 to 50° C., more preferably 30 to 40° C. The time for wet crushing is preferably 10 to 120 minutes, more preferably 30 to 70 minutes.

In the surface treatment process by the above wet processing, the amount of the surface treatment agent used depends on an intended Pe number and the type of the surface treatment agent and thus cannot be specified. The amount of the surface treatment agent is preferably selected appropriately for the surface treatment. For example, the amount of the surface treatment agent used, when the reactive organosilicon compound is used, is preferably 0.1 to 20 parts by mass, more preferably 1 to 15 parts by mass per 100 parts by mass of the untreated metal oxide fine particles. When the organotitanium compound is used, the amount of the surface treatment agent used is preferably 0.1 to 20 parts by mass, more preferably 2 to 15 parts by mass per 100 parts by mass of the untreated metal oxide fine particles.

The amount of the solvent added is preferably 100 to 600 parts by mass, more preferably 200 to 500 parts by mass per 100 parts by mass of the untreated metal oxide fine particles.

The surface treatment process with the surface treatment agent of the inorganic compound is not particularly limited and can be carried out by a known method. For example, wet processing may be adopted.

For example, metal oxide fine particles (titanium oxide, number average primary particle size: 50 nm) is dispersed in water at a concentration of 50 to 350 g/L to give an aqueous slurry, to which water-soluble silicate or a water-soluble aluminum compound is added. The resulting mixture is then neutralized by adding an alkali or an acid to deposit silica or alumina on the surface of the titanium oxide, followed by filtration, washing, and drying. When sodium silicate is used as a water-soluble silicate, the mixture can be neutralized by an acid such as sulfuric acid, nitric acid, and hydrochloric acid. Whereas, when aluminum sulfate is used as a water-soluble aluminum compound, the mixture can be neutralized by an alkali such as sodium hydroxide and potassium hydroxide.

In the surface treatment process by the above wet processing, the amount of the surface treatment agent of the inorganic compound used is preferably, for example, 1% to 20% by mass with respect to the metal oxide fine particles (titanium oxide).

When the amount of each surface treatment agent used is not lower than the above lower limit, a satisfactory surface treatment can be carried out on the untreated metal oxide fine particles, thereby retaining the irregular electrons blocking property and substantially suppressing occurrence of image defects such as black spots and fogging. On the other hand, when the amount of each surface treatment agent used is not more than the upper limit, the surface treatment agents react with each other to suppress easy occurrence of leak which is caused by failure of uniform coating of the surface with the metal oxide fine particles.

Binder Resin:

As examples of the binder resin used in Step (1), may be mentioned casein, polyvinyl alcohol, cellulose nitrate, an ethylene-acrylic acid copolymer, a polyamide resin, a polyurethane resin and gelatin. Among these, a polyamide resin is preferred from the viewpoint of the ability to prevent dissolution of the intermediate layer when a coating liquid for forming a charge generating layer described below is applied onto the intermediate layer. Since the above surface-treated metal oxide fine particles are preferably dispersed in an alcohol solvent, alcohol-soluble polyamide resins such as a methoxy methylolated polyamide resin are more preferred as the binder resin.

Solvent:

As the solvent used in Step (1), solvents in which the metal oxide fine particles can be dispersed well and the binder resin can be dissolved are preferred. Specifically, alcohols having 2 to 4 carbon atoms, such as ethanol, n-propyl alcohol, isopropyl alcohol, n-butanol, t-butanol and sec-butanol, are preferred to achieve favorable solubility and coating performance of the polyamide resin which is preferred as a binder resin.

In Step (1), the solvent is preferably used in combination with a cosolvent in order to improve the preservation and the dispersibility of the metal oxide fine particles. As examples of the cosolvent to be used in combination, may be mentioned methanol, benzyl alcohol, toluene, methylene chloride, cyclohexanone and tetrahydrofuran.

The concentration of the binder resin in the coating liquid for forming the intermediate layer can be appropriately selected according to the thickness of the intermediate layer and the coating process thereof. The solvent is preferably 100 to 3,000 parts by mass, more preferably 500 to 2,000 parts by mass per 100 parts by mass of the binder resin.

The total concentration of the metal oxide fine particles in the coating liquid for forming the intermediate layer is preferably 200 to 600 parts by mass, more preferably 250 to 500 parts by mass per 100 parts by mass of the binder resin.

The component ratio in the coating liquid for forming the intermediate layer can be the component ratio in the formed intermediate layer.

As examples of a dispersing unit for dispersing the metal oxide fine particles, may be mentioned an ultrasonic disperser, a bead mill, a ball mill, a sand grinder and a homomixer, but the dispersing unit is not limited thereto.

Foreign matters and aggregates in the coating liquid for forming the intermediate layer are filtered out before coating to suppress occurrence of image defects.

As a drying process of the coating film of the coating liquid for forming the intermediate layer, a known drying process can be appropriately selected according to the type of solvent and the thickness of the film to be formed. Particularly preferred is heat drying.

For the drying conditions, the temperature is, for example, 100 to 150° C.; and the time is, for example, 10 to 60 minutes.

The thickness of the intermediate layer formed in Step (1) is preferably 0.5 to 25 μm, more preferably 1 to 7 μm.

The thickness of the intermediate layer of not smaller than 0.5 μm ensures coating of the entire surface of the conductive support and can block injection of positive holes from the conductive support sufficiently, thereby suppressing occurrence of image defects such as black spots and fogging well. On the other hand, the thickness of the intermediate layer of not more than 25 μm can provide low electrical resistance and sufficient electron transport property, substantially suppressing occurrence of uneven density.

Step (2): Step of Forming Charge Generating Layer:

In Step (2), for example, a charge generating material is added to a solution of a binder resin dissolved in an appropriate solvent and dispersed therein to prepare a coating liquid for forming a charge generating layer. The coating liquid for forming a charge generating layer is applied to the outer periphery of the intermediate layer formed by Step (1) to form a coating film. This coating film is dried to form a charge generating layer. The resulting charge generating layer contains the charge generating material and the binder resin.

When an organic photosensitive layer of a single layer containing the charge generating material and the charge transport material is formed, an organic photosensitive layer can also be formed in the same manner as in forming the charge generating layer.

Binder Resin:

As the binder resin used in Step (2), a known resin can be used. As examples of the binder resin, may be mentioned a polystyrene resin, polyethylene resin, polypropylene resin, acrylic resin, methacrylic resin, vinyl chloride resin, vinyl acetate resin, polyvinyl butyral resin, epoxy resin, polyurethane resin, phenol resin, polyester resin, alkyd resin, polycarbonate resin, silicone resin, melamine resin, copolymer resins containing two or more of these resins (for example, vinyl chloride-vinyl acetate copolymer resin and vinyl chloride-vinyl acetate-maleic anhydride copolymer resin) and poly-vinylcarbazole resin, but the binder resin is not limited thereto. Among these, preferably used is a polyvinyl butyral resin.

The weight-average molecular weight of the binder resin is not particularly limited, but preferably 10,000 to 150,000, more preferably 15,000 to 100,000.

Solvent:

As examples of the solvent used in Step (2), may be mentioned toluene, xylene, methylene chloride, 1,2-dichloroethane, methyl ethyl ketone, cyclohexane, ethyl acetate, butyl acetate, methanol, ethanol, propanol, butanol, methyl cellosolve, ethyl cellosolve, tetrahydrofuran, 1-dioxane, 1,3-dioxolane, pyridine and diethylamine, but the solvent is not limited thereto. These solvents may be used either singly or in any combination thereof. More preferred are methyl ethyl ketone and cyclohexanone.

Charge Generating Material:

Although the charge generating material used in Step (2) is not particularly limited, as examples thereof, may be mentioned azo pigments such as Sudan Red and Diane Blue; quinone pigments such as pyrene quinone and anthanthrone; quinocyanine pigments; perylene pigments; indigo pigments, such as indigo and thioindigo; and phthalocyanine pigments. These charge generating materials may be used either singly or in any combination thereof.

The charge generating material may be selected from the above materials according to the sensitivity to the oscillation wavelength of an exposure light source, and phthalocyanine pigments are preferred to increase the sensitivity to the oscillation wavelength of an exposure light source in digital copying machines.

As phthalocyanine pigments, to increase the sensitivity to the oscillation wavelength of an exposure light source, for example, to a wavelength of 780 nm, a Y-form titanyl phthalocyanine pigment, or a mixture of a titanyl phthalocyanine pigment and a pigment of the adduct of titanyl phthalocyanine and butanediol, particularly a pigment of the adduct of titanyl phthalocyanine and 2,3-butanediol is preferably used. These phthalocyanine pigments are referred to as highly sensitive charge generating materials.

Y-form titanyl phthalocyanine has the maximum diffraction peak at a Bragg angle (2θ±0.2°) of 27.3° in the X-ray diffraction spectrum of the Cu—Kα characteristic X ray.

As examples of the adduct of titanyl phthalocyanine and butanediol, may be mentioned the adduct of titanyl phthalocyanine and 2,3-butanediol. The structure of the adduct of titanyl phthalocyanine and 2,3-butanediol is schematically represented by Formula (A) below.

Formula (A)

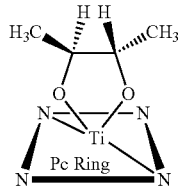

The adduct of titanyl phthalocyanine and 2,3-butanediol may take a different crystal form, depending on the addition ratio of butanediol. To obtain favorable sensitivity, those having a crystal form obtained by reacting 1 mol of titanyl phthalocyanine with not more than 1 mol of a butanediol compound are preferred. The adduct of titanyl phthalocyanine and 2,3-butanediol having such a crystal form has a characteristic peak at least at a Bragg angle (2θ±0.20) of 8.3° in the powder X-ray diffraction spectrum. The adduct of titanyl phthalocyanine and 2,3-butanediol also has peaks at 24.7°, 25.1° and 26.5°, in addition to 8.3°.

The adduct of titanyl phthalocyanine and butanediol may be contained either singly or in combination with non-adduct titanyl phthalocyanine.

As the charge generating material, a mixture of the adduct of titanyl phthalocyanine and 2,3-butanediol and non-adduct titanyl phthalocyanine can also be used. The absorbance ratio of the absorbance at a wavelength of 780 nm, Abs(780), to the absorbance at a wavelength of 700 nm, Abs(700), i.e., Abs (780)/Abs(700), of the organic photosensitive layer is preferably 0.8 to 1.1, wherein the Abs(780) and the Abs(700) are obtained by conversion of the relative reflectance spectrum of an electrophotographic photoreceptor including an organic photosensitive layer (charge generating layer) containing the mixture.

The absorbance ratio, Abs(780)/Abs(700), can be obtained as follows.

(1) First, a photoreceptor sample including, on an aluminum support, a photosensitive layer containing the mixture of the adduct of titanyl phthalocyanine and 2,3-butanediol and non-adduct titanyl phthalocyanine is prepared. The absorption spectrum of the relative reflected light of the photoreceptor sample is then measured. The absorption spectrum of the reflected light can be measured using an optical thickness measuring device "Solid Lambda Thickness" (manufactured by Spectra Co-op).

Specifically, the reflection intensity of the aluminum support at each wavelength is first measured as a baseline. Next, the reflection intensity of the photoreceptor sample at each wavelength is measured. The reflection intensity of the photoreceptor sample at each wavelength is divided by the reflection intensity of the aluminum support at each wavelength to give "relative reflectance ($R_\lambda$)", thereby obtaining the relative reflectance spectrum.

(2) Next, the obtained relative reflectance spectrum of the photoreceptor sample is converted into the absorbance spectrum on the basis of Equation (2) below.

$$\mathrm{Abs}\lambda = -\log(R_\lambda) \qquad \text{Equation (2):}$$

[wherein, $R_\lambda$ represents the relative reflectance obtained by dividing the reflection intensity of the photoreceptor sample at wavelength λ by the reflection intensity of the aluminum support at wavelength λ.]

(3) Next, to remove fluctuations caused by interference fringes, the absorbance spectrum data obtained by the conversion in the above (2) is approximated to a quadratic polynomial within a wavelength range of 765 to 795 nm and within a wavelength range of 685 to 715 nm.

(4) Then, the absorbance Abs(780) at a wavelength of 780 nm and the absorbance Abs(700) at a wavelength of 700 nm in the approximated quadratic polynomial are obtained. The absorbance ratio, Abs(780)/Abs(700), is calculated from the obtained absorbances.

With respect to the adduct of titanyl phthalocyanine and butanediol, the absorbance ratio, Abs(780)/Abs(700), of the absorbance Abs(780) at a wavelength of 780 nm to the absorbance Abs(700) at a wavelength of 700 nm of the organic photosensitive layer (charge generating layer) containing the adduct of titanyl phthalocyanine and butanediol is preferably 0.8 to 1.1, wherein the Abs(780) and the Abs(700) are obtained from the conversion of the relative reflectance spectrum of the organic photoreceptor having the organic photosensitive layer. When the absorbance ratio, Abs(780)/Abs (700), of the organic photosensitive layer containing the adduct of titanyl phthalocyanine and butanediol falls within the above range, appropriate dispersion shearing easily stabilizes the pigment crystal and also stabilizes the photosensitivity and the image properties associated with repeated exposure.

The absorbance ratio of the organic photosensitive layer containing the adduct of titanyl phthalocyanine and butanediol can be measured in the same manner as described above.

The concentration of the binder resin in the coating liquid for forming the charge generating layer can be appropriately selected to obtain a viscosity suitable for coating. The solvent is preferably 100 to 5,000 parts by mass, more preferably 1,000 to 4,000 parts by mass per 100 parts by mass of the binder resin.

The concentration of the charge generating material in the coating liquid for forming the charge generating layer is preferably 20 to 600 parts by mass, more preferably 50 to 500 parts by mass per 100 parts by mass of the binder resin.

When the amount of the charge generating material added falls within the above range, the formed charge generating layer can generate sufficient charges by exposure to provide an organic photosensitive layer (charge generating layer) having sufficient sensitivity and to prevent an increase in residual potential associated with repeated use.

The component ratio in the coating liquid for forming the charge generating layer can be the component ratio in the formed charge generating layer.

As a dispersing unit for dispersing the charge generating material, the same dispersing unit as used for the metal oxide fine particles in the intermediate layer, as described above, can be adopted.

In addition, foreign matters and aggregates in the coating liquid for the charge generating layer are filtered out before coating to suppress occurrence of image defects. The coating process described above can also be adopted.

The thickness of the charge generating layer formed in Step (2) depends on the characteristics of the charge generating material as well as the characteristics and the ratio of the binder resin added, but is preferably 0.01 to 5 μm, more preferably 0.05 to 3 μm.

Step (3): Step of Forming Charge Transport Layer:

In Step (3), for example, a charge transport material is added to a solution of a binder resin dissolved in an appropriate solvent to prepare a coating liquid for forming a charge transport layer. The coating liquid for forming a charge transport layer is applied to the outer periphery of the charge generating layer formed in Step (2) to form a coating film. This coating film is dried to form a charge transport layer. This formed charge transport layer contains the charge transport material and the binder resin.

Binder Resin:

As the binder resin used in Step (3), a known resin can be used. As examples of the binder resin, may be mentioned a polyester resin, polystyrene resin, acrylic resin, vinyl chloride resin, vinyl acetate resin, polyvinyl butyral resin, epoxy resin, polyurethane resin, phenol resin, alkyd resin, polycarbonate resin, silicone resin, melamine resin, styrene-acrylonitrile copolymer resin, polymethacrylate resin and styrene-methacrylate copolymer resin. These resins may be used either singly or in any combination thereof. Among these, a polycarbonate resin is preferred because of low water absorption and favorable dispersibility of the charge transport material.

Solvent:

As examples of the solvent used in Step (3), may be mentioned toluene, xylene, methylene chloride, 1,2-dichloroethane, methyl ethyl ketone, cyclohexane, ethyl acetate, butyl acetate, methanol, ethanol, propanol, butanol, tetrahydrofuran, 1,4-dioxane, 1,3-dioxolane, pyridine and diethylamine, but the solvent is not limited thereto.

Charge Transport Material:

As examples of the charge transport material used in Step (3), may be mentioned carbazole derivatives, oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, styryl compounds, hydrazone compounds, pyrazoline compounds, oxazolone derivatives, benzimidazole derivatives, quinazoline derivatives, benzofuran derivatives, acridine derivatives, phenazine derivatives, aminostilbene derivatives, triallylamine derivatives, phenylenediamine derivatives, stilbene derivatives, benzidine derivatives, poly-N-vinylcarbazole, poly-1-vinylpyrene, poly-9-vinylanthracene and triphenylamine derivatives. These charge transport materials may be used either singly or in any combination thereof.

The coating liquid for forming the charge transport layer may optionally contain an antioxidant, an electroconductive agent, a stabilizer, and the like. As examples of the antioxidant, may be mentioned those described in Japanese Patent Application Laid-Open No. Hei. 11-200135, and as examples of the electroconductive agent, may be mentioned those described in Japanese Patent Application Laid-Open No. Sho. 50-137543 and No. Sho. 58-76483 and the like.

The concentration of the binder resin in the coating liquid for forming the charge transport layer can be appropriately selected to obtain a viscosity suitable for the above coating process. The solvent is preferably 100 to 1,000 parts by mass, more preferably 400 to 800 parts by mass per 100 parts by mass of the binder resin.

The concentration of the charge transport material in the coating liquid for forming the charge transport layer is preferably 30 to 150 parts by mass, more preferably 60 to 90 parts by mass per 100 parts by mass of the binder resin.

As a dispersing unit for dispersing the charge transport material, the same dispersing unit as used for the metal oxide fine particles in the intermediate layer, as described above, can be adopted.

In addition, foreign matters and aggregates in the coating liquid for the charge transport layer are filtered out before coating to suppress occurrence of image defects.

The thickness of the charge transport layer formed in Step (3) depends on the characteristics of the charge transport material as well as the characteristics and the mixing ratio of the binder resin, but is preferably 5 to 40 μm, more preferably 10 to 30 μm.

Step of Forming Protective Layer:

The organic photoreceptor obtained by the production process of the present invention may further have a protective layer on the organic photosensitive layer. The protective layer has a function of protecting the organic photoreceptor against external environments and impacts. When the protective layer is formed, the protective layer preferably contains inorganic particles and a binder resin, and may optionally contain other components such as an antioxidant and a lubricant.

As examples of the process of forming the protective layer, may be mentioned a process including: dissolving or dispersing inorganic particles and a binder resin in an appropriate solvent to prepare a coating liquid for forming the protective layer; applying the coating liquid for forming the protective layer to the outer periphery of the organic photosensitive layer to form a coating film; and drying the coating film.

As examples of the inorganic particles used in the step of forming the protective layer, may be preferably used particles of silica, alumina, strontium titanate, zinc oxide, titanium oxide, tin oxide, antimony oxide, indium oxide, bismuth oxide, tin-doped indium oxide, antimony-doped or tantalum-doped tin oxide, zirconium oxide and the like. In particular, preferred are hydrophobic silica, hydrophobic alumina, and hydrophobic zirconia, having hydrophobic surfaces, and fine powder of sintered silica and the like.

The number average primary particle size of the inorganic particles is preferably 1 to 300 nm, more preferably 5 to 100 nm.

In the present invention, the number average primary particle size of the inorganic particles is the value obtained by randomly observing 300 particles as primary particles through a transmission electron microscope at a magnification of 10,000 times and calculating the measured value as the number average size of the Feret diameter on the basis of the image analysis.

The binder resin used in the step of forming the protective layer may be either a thermoplastic resin or a thermosetting resin. As examples of the binder resin, may be mentioned a polyvinyl butyral resin, epoxy resin, polyurethane resin, phenol resin, polyester resin, alkyd resin, polycarbonate resin, silicone resin and melamine resin.

When the protective layer contains a lubricant, as examples of the lubricant, may be mentioned fine powders of resins (for example, a fluorine resin, polyolefin resin, silicone resin, melamine resin, urea resin, acrylic resin and styrene resin), fine powders of metal oxides (for example, titanium oxide, aluminum oxide and tin oxide), solid lubricants (for example, polytetrafluoroethylene, polychlorotrifluoroethylene, polyvinylidene fluoride, zinc stearate and aluminum stearate), silicone oils (for example, dimethyl silicone oil, methyl phenyl silicone oil, methyl hydrogen polysiloxane, cyclic dimethyl polysiloxane, alkyl-modified silicone oil, polyether-modified silicone oil, alcohol-modified silicone oil, fluorine-modified silicone oil, amino-modified silicone oil, mercapto-modified silicone oil, epoxy-modified silicone oil, carboxyl-modified silicone oil and higher fatty acid-modified silicone oil), fluorine resin powders (for example, tetrafluoroethylene resin powder, trifluorochloroethylene resin powder, hexafluoroethylene propylene resin powder, vinyl fluoride resin powder, vinylidene fluoride resin powder, dichloroethylene fluoride resin powder and copolymers thereof), and polyolefin resin powders (for example, homopolymer resin powders such as polyethylene resin powder, polypropylene resin powder, polybutene resin powder and polyhexene resin powder; copolymer resin powders such as an ethylene-propylene copolymer and an ethylene-butene copolymer; ternary copolymers of these copolymers and hexene or the like; and polyolefin resin powders such as thermally modified products of these resin powders).

The thickness of the protective layer formed by the step of forming the protective layer is preferably 0.2 to 10 μm, more preferably 0.5 to 5 μm.

Image Forming Apparatus:

The organic photoreceptor obtained by the production process of the present invention can be used in known various image forming apparatuses such as monochrome image forming apparatuses and full-color image forming apparatuses.

An image forming apparatus using the organic photoreceptor according to the present invention, for example, includes: a charging unit which applies uniform charge potential onto the organic photoreceptor; an exposure unit which forms an electrostatic latent image on the organic photoreceptor to which uniform charge potential is applied; a developing unit which develops the electrostatic latent image through a toner to form a toner image; a transfer unit which transfers the toner image onto a transfer material; a fixing unit which fixes the toner image to the transfer material; and a cleaning unit which removes the toner remaining on the organic photoreceptor.

In the above image forming apparatus, the exposure unit is preferably a semiconductor laser or a light emitting diode having an oscillation wavelength of not less than 50% of the maximum absorbance of the charge generating material to be used. For example, when a mixture of the adduct of titanyl phthalocyanine and 2,3-butanediol and non-adduct titanyl phthalocyanine is used as a charge generating material, the oscillation wavelength of the exposure unit is preferably 650 to 800 nm. When such exposure units are used to narrow the exposure dot diameter in the main scanning direction of writing to 10 to 100 μm to perform digital exposure on the photoreceptor, an electrophotographic image having a high resolution of 600 dpi (dpi: the number of dots per 2.54 cm) to 2,400 dpi or higher can be formed.

The exposure dot diameter refers to a length Ld of an exposure beam in the main scanning direction in the region where the exposure beam has an intensity of not less than $1/e^2$ of the peak intensity (Ld: measured at a maximum length position).

Toner:

The electrostatic latent image formed on the organic photoreceptor obtained by the production process of the present invention is developed as a toner image. The toner used in this development may be a pulverized toner or a polymerized toner, but preferably a polymerized toner produced by a polymerization method from the viewpoint of stable particle size distribution.

A polymerized toner refers to a toner obtained by producing a binder resin (hereinafter, also referred to as a "binder resin for toners") and shaping the toner through the polymerization reaction of material monomers of the binder resin for toners followed by an optional chemical treatment. Specifically, the polymerized toner is formed by a polymerization reaction such as suspension polymerization and emulsion polymerization, followed by an optional process of fusing particles together.

The volume average particle size (Dv50) of the toner particles constituting the toner is preferably 2 to 9 μm, more preferably 3 to 7 μm.

The particle size of the toner particles within the above range can increase the resolution of the formed image and further can reduce the amount of the toner particles even having a small and fine particle size to improve the reproducibility of a dot image over a long period of time and to form a sharp and stable image.

The volume average particle size (Dv50) of the toner particles can be measured and calculated using a measuring device "Multisizer 3" (manufactured by Beckman Coulter, Inc.) connected to a computer system (manufactured by Beckman Coulter, Inc.) for data processing.

Developer:

The toner according to the present invention may be used as a one-component developer or a two-component developer.

For use as a one-component developer, as examples of the one-component developer, may be mentioned non-magnetic one-component developers, and magnetic one-component developers obtained by containing about 0.1 to 0.5 μm of magnetic particles in a toner, any of which may be used.

In addition, the toner can be mixed with a carrier and used as a two-component developer. In this case, as magnetic particles for the carrier, conventionally known materials may be used, such as metals such as iron, ferrite and magnetite, and alloys of these metals with metals such as aluminum and lead. In particular, ferrite particles are preferred.

The volume average particle size (Dv50) of the magnetic particles constituting the carrier is preferably 15 to 100 μm, more preferably 25 to 80 μm.

In the present invention, the volume average particle size (Dv50) of the magnetic particles is measured with a laser diffraction type particle size distribution measuring device "HELOS" (manufactured by Sympatec) equipped with a wet disperser.

The carrier is preferably a resin-coated type, in which the magnetic particles is coated with a resin, or a resin-dispersion type, in which the magnetic particles are dispersed in a resin. As examples of the coating resin for constituting the resin-coated type carrier, although not particularly limited, may be mentioned an olefin resin, styrene resin, styrene acrylic resin, silicone resin, ester resin and fluorine-containing polymer resin. The dispersion resin for constituting the resin-dispersion carrier is not particularly limited and known ones can be used. As examples of the dispersion resin, may be mentioned a styrene acrylic resin, polyester resin, fluorine resin and phenol resin.

The production process of the organic photoreceptor of the present invention includes: applying a coating liquid for forming an intermediate layer to form a coating film, the coating liquid being obtained by dissolving a binder resin in a solvent and dispersing first and second metal oxide fine particles therein; and drying the coating film, and the Pe number of the first metal oxide fine particles is two or more times larger than that of the second metal oxide fine particles, the Pe number being measured under specific measurement conditions. Accordingly, an organic photoreceptor which can suppress occurrence of uneven density and image defects such as spots and fogging can be produced. Furthermore, even when an organic photosensitive layer using a higher sensitive charge generating material is formed in the organic photoreceptor, the same effects can be obtained.

EXAMPLES

Examples of the present invention will hereinafter be described, but the present invention is not limited to these Examples.

Measurement of Pe Number:

In this Example, the Pe number represented by the Equation (1) was measured as follows.

As a binder resin, 100 parts by mass of a polyamide resin represented by Formula (1) below was added to 1700 parts by mass of a mixed solvent of ethanol/n-propyl alcohol/tetrahydrofuran (volume ratio: 45/20/35) and mixed under stirring at 20° C. To this solution, 260 parts by mass of metal oxide fine particles were added and dispersed therein with a bead mill for a mill retention time of 5 hours to prepare Pe number evaluation liquid 1.

The liquid film contraction rate (E) of Pe number evaluation liquid 1 was calculated by dividing, by the time for drying, the value obtained by subtracting the dry film thickness from the wet film thickness (H) just after coating, when the wet film was formed to have a thickness (H) of 32 μm with a liquid temperature (T) of 296 K.

In addition, as a binder resin, 100 parts by mass of a polyamide resin represented by Formula (1) below was added to 850 parts by mass of a mixed solvent of ethanol/n-propyl alcohol/tetrahydrofuran (volume ratio: 45/20/35) and mixed under stirring at 20° C. To this solution, 260 parts by mass of metal oxide fine particles were added and dispersed therein with a bead mill for a mill retention time of 5 hours to prepare Pe number evaluation liquid 2.

The viscosity (μ) of Pe number evaluation liquid 2 was measured at a liquid temperature (T) of 296 K using a B-type viscometer "Model: BL" (manufactured by Tokyo Keiki Inc.).

Furthermore, the number average primary particle size (R) was obtained by the following procedure: observing the TEM (transmission electron microscope) image of the metal oxide fine particles at a magnification of 100,000 times; randomly selecting 100 particles as primary particles; measuring the horizontal Feret diameters of these primary particles on the basis of the image analysis; and calculating the average of the diameters as a "number average primary particle size."

Formula (1)

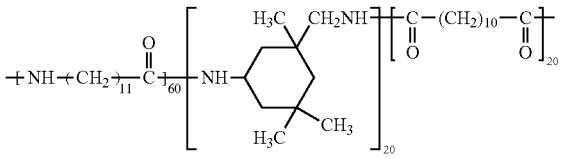

Manufacture of Surface-Treated Metal Oxide Fine Particles 1:

Five hundred parts by mass of an inorganic treated titanium oxide "MT-500SA" (manufactured by Tayca Corporation) in which a rutile type titanium dioxide was treated with silica and alumina, 25 parts by mass of methyl hydrogen polysiloxane (MHPS), and 1500 parts by mass of toluene were mixed under stirring, followed by wet crushing with a bead mill for a mill retention time of 25 minutes at 35° C. From the slurry obtained by the wet crushing, toluene was removed off by vacuum distillation. The obtained dried material was subjected to baked coating of MHPS at 120° C. for 2 hours. The resulting material was then crashed with a pin mill to obtain surface-treated metal oxide fine particles [1] having a number average primary particle size of 35 nm and an aspect ratio of 1.3. The Pe number of the metal oxide fine particles [1] was 115.

Manufacture of Surface-Treated Metal Oxide Fine Particles 2:

Five hundred parts by mass of a rutile type titanium dioxide was mixed under stirring with 2,000 parts by mass of toluene, to which 60 parts by mass of 3-methacryloxy propyl trimethoxysilane "KBM-503" (manufactured by Shin-Etsu Chemical. Co., Ltd.) was added and stirred at 50° C. for 3 hours. Subsequently, toluene was evaporated off by vacuum distillation, followed by baked coating at 1.30° C. for 3 hours, which provided surface-treated metal oxide fine particles [2] having a number average primary particle size of 15 nm and an aspect ratio of 5.0. The Pe number of the metal oxide fine particles [2] was 614.

Manufacture of Surface-Treated Metal Oxide Fine Particles 3:

Five hundred parts by mass of an inorganic treated titanium oxide "MT-100SA" (manufactured by Tayca Corporation) in which a rutile type titanium dioxide was treated with silica and alumina, 25 parts by mass of MHPS, and 1300 parts by mass of toluene were mixed under stirring, followed by wet crushing with a bead mill for a mill retention time of 40 minutes at 35° C. From the slurry obtained by the wet crushing, toluene was removed off by vacuum distillation. The obtained dried material was subjected to baked coating of MHPS at 120° C. for 2 hours. The resulting material was then crashed with a pin mill to obtain surface-treated metal oxide fine particles [3] having a number average primary particle size of 15 nm and an aspect ratio of 3.5. The Pe number of the metal oxide fine particles [3] was 328.

Manufacture of Surface-Treated Metal Oxide Fine Particles 4:

One hundred parts by mass of a rutile type titanium dioxide was mixed under stirring with 500 parts by mass of toluene, to which 5.5 parts by mass of titanium dioctyloxy bis(octylene glycolate) "TC-200" (manufactured by Matsumoto Trading Co., Ltd.) was added as a titanium chelate and stirred at 80° C. for 2 hours. Subsequently, toluene was evaporated off by vacuum distillation, followed by baked coating at 180° C. for 3 hours, which provided titanium chelate surface-treated metal oxide fine particles. Five hundred parts by mass of the metal oxide fine particles described above and 30 parts by mass of methyl hydrogen polysiloxane (MHPS) were mixed under stirring with 1500 parts by mass of toluene, followed by wet crushing with a bead mill for a mill retention time of 25 minutes at 35±5° C. From the slurry obtained by the wet crushing, toluene was removed off by vacuum distillation with a kneader, followed by baked coating of the surface treatment agents at 120° C. for 2 hours. The powder obtained after the baked coating was allowed to cool to a room temperature and crashed with a pin mill to provide metal oxide fine particles [4] having the surface treated with the titanium chelate and MHPS. The number average primary particle size, the aspect ratio and the Pe number of the metal oxide fine particles [4] were 35 nm, 1.2 and 153, respectively.

Manufacture of Surface-Treated Metal Oxide Fine Particles 5:

Five hundred parts by mass of an anatase type titanium dioxide was mixed under stirring with 1500 parts by mass of toluene, to which 50 parts by mass of titanium acylate "ORGATIX TPHS" (manufactured by Matsumoto Fine Chemical Co., Ltd.) was added and stirred at 50° C. for 2 hours. Subsequently, toluene was evaporated off by vacuum distillation, followed by baked coating at 120° C. for 2 hours. Five hundred parts by mass of the metal oxide fine particles and 30 parts by mass of methyl hydrogen polysiloxane (MHPS) were mixed under stirring with 1500 parts by mass of toluene, followed by wet crushing with a bead mill for a mill retention time of 25 minutes at 35±5° C. From the slurry obtained by the wet crushing, toluene was removed off by vacuum distillation with a kneader, followed by baked coating of the surface treatment agents at 120° C. for 2 hours. The powder obtained after the baked coating was allowed to cool to a room temperature and crushed with a pin mill to provide metal oxide fine particles [5] having the surface treated with the titanium acylate and MHPS. The number average primary particle size, the aspect ratio and the Pe number of the metal oxide fine particles [5] were 25 nm, 1.1 and 137, respectively.

Manufacture of Surface-Treated Metal Oxide Fine Particles 6:

Five hundred parts by mass of an inorganic treated zinc oxide (manufactured by Sakai Chemical Industry Co., Ltd.) in which zinc oxide was treated with silica, 40 parts by mass of MHPS, and 1800 parts by mass of toluene were mixed under stirring, followed by wet crushing with a bead mill for a mill retention time of 60 minutes at 35° C. From the slurry obtained by the wet crushing, toluene was removed off by vacuum distillation. The obtained dried material was subjected to baked coating of MHPS at 120° C. for 2 hours. The resulting material was then crashed with a pin mill to obtain surface-treated metal oxide fine particles [6]. The number average primary particle size, the aspect ratio and the Pe number of the metal oxide fine particles [6] were 20 nm, 1.4 and 109, respectively.

Manufacture of Surface-Treated Metal Oxide Fine Particles 7:

Surface-treated metal oxide fine particles [7] were obtained in the same manner as in the manufacture of surface-treated metal oxide fine particles 3, except that the amount of MHPS added was changed to 10 parts by mass. The number average primary particle size, the aspect ratio and the Pe number of the metal oxide fine particles [7] were 15 nm, 3.5 and 573, respectively.

Production Example of Organic Photoreceptor 1

Example 1

"Organic photoreceptor [1]" including, on a conductive support, an intermediate layer, a charge generating layer and a charge transport layer in order was manufactured according to the following procedure.

(1) Manufacture of Conductive Support

An aluminum alloy tube with a length of 362±0.2 mm was mounted on an NC lathe and machined with a sintered diamond bit to have an outer diameter of 59.95±0.04 mm and $Rz_{jis}$ of the surface of 1.2±0.2 μm, whereby manufacturing a conductive support [1].

(2) Formation of Intermediate Layer:

As a binder resin, 100 parts by mass of the polyamide resin represented by the Formula (1) above was added to 1700 parts by mass of a mixed solvent of ethanol/n-propyl alcohol/tetrahydrofuran (volume ratio: 45/20/35) and mixed under stirring at 20° C. To this solution, 200 parts by mass of the metal oxide fine particles (2 and 150 parts by mass of the metal oxide fine particles [1] were added and dispersed therein with a bead mill for a mill retention time of 5 hours. This solution was allowed to stand for a day and night and filtered to prepare a coating liquid for forming an intermediate layer. The filtration was performed under a pressure of 50 kPa using, as a filter, Rigimesh Filter (manufactured by Pall Corporation) having a nominal filtration rating of 5 μm. The obtained coating liquid for forming an intermediate layer was applied by dip coating to the outer periphery of the washed conductive support [1] to form a coating film. The coating film was then dried at 120° C. for 30 minutes to form an intermediate layer [1] having a thickness of 2 μm.

(3) Formation of Charge Generating Layer:

(3-1) Synthesis of Charge Generating Material:

Crude titanyl phthalocyanine was synthesized from 1,3-diiminoisoindoline and titanium tetra-n-butoxide. The obtained crude titanyl phthalocyanine was dissolved in sulfuric acid to prepare a solution, and the solution was poured into water to deposit a crystal. The solution was filtered and the obtained crystal was washed with water sufficiently to provide a wet paste. Next, the wet paste was frozen in a freezer and then defrosted, followed by filtration and drying to obtain amorphous titanyl phthalocyanine.

The obtained amorphous titanyl phthalocyanine was mixed with (2R,3R)-2,3-butanediol in ortho-dichlorobenzene (ODB) at an equivalent ratio of (2R,3R)-2,3-butanediol to amorphous titanyl phthalocyanine of 0.6. The obtained mixture was heated under stirring at 60 to 70° C. for 6 hours. The resulting solution was allowed to stand overnight and then methanol was further added thereto to deposit a crystal. After filtering the solution, the obtained crystal were washed with methanol to provide a charge generating material [1] containing the adduct of titanyl phthalocyanine and (2R,3R)-2,3-butanediol.

The X-ray diffraction spectrum of the charge generating material [1] was measured and as a result, peaks at 8.3°, 24.7°, 25.1° and 26.5° were observed. The obtained charge generating material [1] was considered as a mixture of a 1:1 adduct of titanyl phthalocyanine and (2R,3R)-2,3-butanediol and titanyl phthalocyanine (non-adduct).

The relative reflectance spectrum of the obtained photoreceptor was measured using an optical thickness measuring device Solid Lambda Thickness (manufactured by Spectra Co-op) according to the following procedure.

(1) First, the reflection intensity of the aluminum support at each wavelength was measured as a baseline. Next, the reflection intensity of a photoreceptor sample at each wavelength was measured. Then, the reflection intensity of the photoreceptor sample at each wavelength was divided by the reflection intensity of the aluminum support to give "relative reflectance ($R_\lambda$)," whereby obtaining a relative reflectance spectrum.

(2) The obtained relative reflectance spectrum of the photoreceptor sample was converted into the absorbance spectrum based on Equation (2) below.

$$\mathrm{Abs}\lambda = -\log(R_\lambda) \qquad \text{Equation (2):}$$

[wherein, $R_\lambda$ represents the relative reflectance obtained by dividing the reflection intensity of the photoreceptor sample at wavelength λ by the reflection intensity of the aluminum support at wavelength λ.]

(3) Next, to remove fluctuations caused by interference fringes, the absorbance spectrum data obtained by the conversion in the above (2) was approximated to a quadratic polynomial within a wavelength range of 765 to 795 nm and within a wavelength range of 685 to 715 nm.

(4) The absorbance Abs(780) at a wavelength of 780 nm and the absorbance Abs(700) at a wavelength of 700 nm in the approximated quadratic polynomial were obtained to calculate the absorbance ratio Abs(780)/Abs(700). The obtained absorbance ratio, Abs(780)/Abs(700), was 0.99.

(3-2) Formation of Charge Generating Layer:

The following components were mixed and dispersed with a circulating ultrasonic homogenizer "RUS-600TCVP" (19.5 kHz, 600 W, manufactured by NISSEI Corporation) at a circulating flow rate of 40 L/H for 0.5 hours to prepare coating liquid [1] for forming a charge generating layer.

Charge Generating Material[1]: 24 parts by mass

Polyvinyl butyral resin "S-LEC BL-1" (manufactured by Sekisui Chemical Co., Ltd.): 12 parts by mass Solvent, methyl ethyl ketone/cyclohexanone=4/1 (V/V): 400 parts by mass The coating liquid [1] for forming a charge generating layer was applied onto the above intermediate layer [1] by dip coating to form a coating film. The coating film was dried to from the charge generating layer [1] having a thickness of 0.3 μm.

(4) Formation of Charge Transport Layer:

The following components were mixed to prepare a coating liquid for forming a charge transport layer. The coating liquid for forming a charge transport layer was applied onto the charge generating layer [1] by dip coating as described above to form a coating film. The coating film was then dried to form the charge transport layer [1] having a thickness of 25 μm, whereby producing the organic photoreceptor [1].

Charge Transport Material: a compound represented by the Formula (CTM-1) below: 225 parts by mass Polycarbonate resin "Z300" (manufactured by Mitsubishi Gas Chemical Company, Inc.): 300 parts by mass Antioxidant "Irganox 1010" (manufactured by Ciba-Geigy Japan Ltd.): 6 parts by mass Solvent, mixture of tetrahydrofuran/toluene (volume ratio: 3/1): 2,000 parts by mass Leveling agent, Silicone oil "KF-54" (manufactured by Shin-Etsu Chemical Co., Ltd.): 1 part by mass Formula (CTM-1)

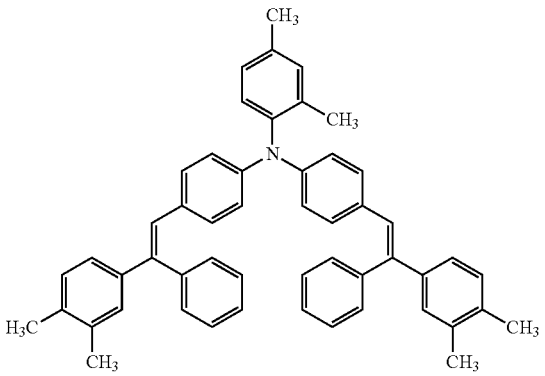

except that the coating liquid [1] for forming a charge generating layer was changed to the coating liquid [2] for forming a charge generating layer described below.

Production Example of Organic Photoreceptor 10

Comparative Example 4

An organic photoreceptor [10] was produced in the same manner as in Production Example of organic photoreceptor 9, except that the coating liquid [1] for forming a charge generating layer was changed to the coating liquid [2] for forming a charge generating layer described below.

Preparation of Coating Liquid 2 for Forming Charge Generating Layer:

The following components were mixed and dispersed with a sand mill disperser for 15 hours to prepare a coating liquid [2] for forming a charge generating layer.

Charge generating material, Y-form titanyl phthalocyanine (titanyl phthalocyanine pigment having the maximum diffraction peak at a Bragg angle (2θ±0.2°) of 27.3° in the X-ray diffraction spectrum of the Cu—Kα characteristic X ray): 20 parts by mass Polyvinyl butyral resin "BM-1" (manufactured by Sekisui Chemical. Co., Ltd.): 10 parts by mass Solvent, methyl ethyl ketone: 700 parts by mass Solvent, cyclohexanone: 300 parts by mass

TABLE 1

| | | INTERMEDIATE LAYER | | | | | | |
|---|---|---|---|---|---|---|---|---|
| | | FIRST METAL OXIDE FINE PARTICLES | | | SECOND METAL OXIDE FINE PARTICLES | | | |
| | PHOTORECEPTOR NO. | No. | Pe NUMBER | AMOUNT OF ADDITION (PARTS BY MASS) | No. | Pe NUMBER | AMOUNT OF ADDITION (PARTS BY MASS) | RATIO OF Pe NUMBER |
| EXAMPLE 1 | 1 | 2 | 614 | 200 | 1 | 115 | 150 | 5.3 |
| EXAMPLE 2 | 2 | 3 | 328 | 200 | 1 | 115 | 160 | 2.9 |
| EXAMPLE 3 | 3 | 3 | 328 | 210 | 5 | 137 | 150 | 2.4 |
| EXAMPLE 4 | 4 | 3 | 328 | 190 | 6 | 109 | 155 | 3.0 |
| EXAMPLE 5 | 5 | 3 | 328 | 195 | 6 | 108 | 165 | 3.0 |
| EXAMPLE 6 | 6 | 7 | 573 | 210 | 1 | 115 | 170 | 5.0 |
| COMPARATIVE EXAMPLE 1 | 7 | 4 | 153 | 230 | 1 | 115 | 140 | 1.3 |
| COMPARATIVE EXAMPLE 2 | 8 | 4 | 153 | 200 | 5 | 137 | 135 | 1.1 |
| COMPARATIVE EXAMPLE 3 | 9 | 4 | 153 | 190 | 6 | 109 | 150 | 1.4 |
| COMPARATIVE EXAMPLE 4 | 10 | 4 | 153 | 220 | 6 | 109 | 180 | 1.4 |

Production Examples of Organic Photoreceptors 2 to 4, 6 to 9

Examples 2 to 4 and 6, Comparative Examples 1 to 3

Organic photoreceptors [2] to [4] and [6] to [9] were produced in the same manner as in Production Example of organic photoreceptor 1, except that the type and the amount of metal oxide fine particles added to a coating liquid for forming an intermediate layer were changed according to Table 1 below.

Production Example of Organic Photoreceptor 5

Example 5

An organic photoreceptor [5] was produced in the same manner as in Production Example of organic photoreceptor 4, Organic photoreceptors [1] to [10] obtained above were installed in a full color image forming apparatus "bizhub PRO C6501" (manufactured by Konica Minolta Business Technologies, Inc.; tandem-type color multifunction printer with semiconductor laser exposure at 780 nm, reversal development, and an intermediate transcription body) to print character images with an image ratio of 6% on 300,000 A4 sheets by long edge feed under an environment of a temperature of 23° C. and a humidity of 50% RH for durability printing. The surface potential and fogging before and after the durability printing as well as the uneven density after the durability printing were evaluated. The results are shown in Table 2.

(1) Surface Potential of Organic Photoreceptor:

Each organic photoreceptor was set in an electrical characteristic measuring device to measure the surface potential of the photoreceptor. To measure the surface potential, charging and exposure were repeated under the conditions of a grid voltage of −800 V and an exposure amount of 0.5 μJ/cm$^2$ while the organic photoreceptor was rotated at 130 rpm under an environment of a temperature of 10° C. and a humidity of 15% RH. The potential Via of the photoreceptor after exposure in the first rotation (early stage) and the potential Vib after exposure in the 65th rotation (after 30 seconds) were measured to calculate the difference between the potentials ($\Delta Vi=|Vib-Via|$). The evaluation of ΔVi was performed on the basis of the following criteria.

A: ΔVi was not more than 20 V both before and after durability printing

B: ΔVi was not more than 20 V before durability printing, and more than 20 V and not more than 30 V after durability printing.

C: ΔVi was more than 20 V and not more than 30 V before durability printing, or not more than 20 V before durability printing and more than 30 V after durability printing (NG).

D: ΔVi was more than 30 V before durability printing (NG).

(2) Image Quality:

(2-1) Uneven density:

Each organic photoreceptor was placed in the position of a black (BK) image forming unit of the image forming apparatus. The transfer current was changed from 20 μA to 100 μA by an increment of 10 μA to output a chart shown in FIG. 1. "POD GLOSS COAT (A3 size, 100 g/m$^2$)" (manufactured by Oji Paper Co., Ltd.) was used as an image support. The formed image was visually observed in terms of density and evaluated based on the following criteria.

A: no uneven density even at a transfer current of not less than 60 μA.

B: slight uneven density at a transfer current of not less than 60 μA, but acceptable for practical use.

C: slight uneven density at a transfer current of 40 to 50 μA, but acceptable for practical use (but unacceptable for formation of high quality images) (NG).

D: obvious uneven density even at a transfer current of lower than 40 μA, and unacceptable for practical use (NG).

(2-2) Fogging (Sensory Evaluation):

Each organic photoreceptor was disposed in the position of a black (BK) image forming unit of the image forming apparatus. A white image support "POD GLOSS COAT (A3 size, 100 g/m$^2$)" (manufactured by Oji Paper Co., Ltd.) was prepared. The image support was conveyed to the position of black to form a blank image (solid white image) under the conditions of a grid voltage of −800 V and a developing bias of −650 V. The presence or absence of fogging on the obtained image support was then evaluated.

A: no fogging

B: slight fogging when enlarged, but acceptable for practical use.

C: slight fogging by visual observation, and unacceptable for practical use (NG).

D: noticeable fogging (NG)

TABLE 2

| | | | IMAGE QUALITY | | |
|---|---|---|---|---|---|
| | | | | FOGGING | |
| | PHOTORECEPTOR NO. | SURFACE POTENTIAL | UNEVEN DENSITY | BEFORE DURABILITY PRINTING | AFTER DURABILITY PRINTING |
| EXAMPLE 1 | 1 | A | A | A | A |
| EXAMPLE 2 | 2 | A | A | A | B |
| EXAMPLE 3 | 3 | A | A | B | B |
| EXAMPLE 4 | 4 | B | A | A | A |
| EXAMPLE 5 | 5 | B | A | A | A |
| EXAMPLE 6 | 6 | A | A | A | A |
| COMPARATIVE EXAMPLE 1 | 7 | C | B | A | C |
| COMPARATIVE EXAMPLE 2 | 8 | B | C | A | B |
| COMPARATIVE EXAMPLE 3 | 9 | C | B | B | C |
| COMPARATIVE EXAMPLE 4 | 10 | C | B | B | C |

As shown in Table 2, in Examples 1 to 6 using the first and second metal oxide fine particles in the coating liquid for forming the intermediate layer wherein the Pe number of the first metal oxide fine particles was two or more times larger than that of the second metal oxide fine particles, it was found that ΔVi of the surface potentials in the obtained organic photoreceptors was as low as not more than 20 V before the durability printing and not more than 30 V after the durability printing even when sensitive charge generating materials were used, thereby suppressing occurrence of both uneven density and fogging.

Meanwhile, in Comparative Examples 1 to 4 using the first and second metal oxide fine particles wherein the Pe number of the first metal oxide Line particles is less than two times larger than that of the second metal oxide fine particle, it was found that the obtained organic photoreceptors failed to suppress both uneven density and fogging at the same time.

The invention claimed is:

1. A production process of an organic photoreceptor, the organic photoreceptor including a conductive support, an intermediate layer formed on the conductive support, and an organic photosensitive layer stacked on the intermediate layer, the process comprising:

applying a coating liquid for forming the intermediate layer to the conductive support to form a coating film, the coating liquid being obtained by dissolving a binder resin in a solvent and dispersing first metal oxide fine particles and second metal oxide fine particles therein; and drying the coating film, wherein a Pe number of the first metal oxide fine particles is two or more times larger than that of the second metal oxide fine particles when the Pe number defined by a following Equation (1) is measured for following Pe number evaluation liquids under following measurement conditions using the first and second metal oxide fine particles, $$Pe\ \text{number}=(6\pi\mu EHR)/kT \qquad \text{Equation (1):}$$

[in the Equation (1), μ represents a viscosity (Pa·s) of Pe number evaluation liquid 2, E represents a liquid film contraction rate (m/s) when a wet film of Pe number evaluation liquid 1 is formed, H represents a wet film thickness of Pe number evaluation liquid 1, R represents a number average primary particle size (m) of the metal oxide fine particles, k represents Boltzmann constant (J/K), and T represents a liquid temperature (K)], Measurement Conditions:

Pe number evaluation liquid 1: obtained by dissolving 100 parts by mass of a binder resin in 1700 parts by mass of a solvent and dispersing 260 parts by mass of the first or second metal oxide fine particles in the solvent, wherein the binder resin and the solvent are the same as those used in the coating liquid for forming the intermediate layer;

Pe number evaluation liquid 2: obtained by dissolving 100 parts by mass of a binder resin in 850 parts by mass of a solvent and dispersing 260 parts by mass of the first or second metal oxide fine particles in the solvent, wherein the binder resin and the solvent are the same as those used in the coating liquid for forming the intermediate layer;

Liquid temperature: 296 K; and

Wet film thickness: $32\times10^{-6}$ m.

2. The production process of an organic photoreceptor according to claim 1, wherein the Pe number of the first metal oxide fine particles is not less than 200.

3. The production process of an organic photoreceptor according to claim 1, wherein the first metal oxide fine particles and the second metal oxide fine particles are each made of either one of titanium oxide and zinc oxide.

4. The production process of an organic photoreceptor according to claim 3, wherein the first metal oxide fine particles and the second metal oxide fine particles are each made of titanium oxide.

5. The production process of an organic photoreceptor according to claim 4, wherein the first metal oxide fine particles and the second metal oxide fine particles are each made of rutile type titanium oxide.

6. The production process of an organic photoreceptor according to claim 1, wherein the organic photosensitive layer contains as a charge generating material any one of a Y-form titanyl phthalocyanine pigment and a mixture of a titanyl phthalocyanine pigment and a pigment of an adduct of titanyl phthalocyanine and 2,3-butanediol.

7. The production process of an organic photoreceptor according to claim 1, wherein a number average primary particle size of the first metal oxide fine particles and a number average primary particle size of the second metal oxide fine particles are each 5 to 100 nm.

8. The production process of an organic photoreceptor according to claim 7, wherein the number average primary particle size of the first metal oxide fine particles and the number average primary particle size of the second metal oxide fine particles are each 10 to 40 nm.

9. The production process of an organic photoreceptor according to claim 1, wherein a thickness of the intermediate layer is 0.5 to 25 μm.

10. The production process of an organic photoreceptor according to claim 9, wherein the thickness of the intermediate layer is 1 to 7 μm.

* * * * *